US005385287A

United States Patent [19]

Scheuten

[11] Patent Number: 5,385,287

[45] Date of Patent: Jan. 31, 1995

[54] SHEET-STAPLING DEVICE

[75] Inventor: Peter Scheuten, Wolfschlugen, Germany

[73] Assignee: Eastman Kodak Company, Rochester, N.Y.

[21] Appl. No.: 181,933

[22] Filed: Jan. 14, 1994

[30] Foreign Application Priority Data

Feb. 6, 1993 [DE] Germany ..... 4303503

[51] Int. Cl.[6] ..... B27F 7/19

[52] U.S. Cl. ..... 227/155

[58] Field of Search ..... 227/155, 154, 156

[56] References Cited

U.S. PATENT DOCUMENTS

| | | | |
|---|---|---|---|
| 2,585,807 | 2/1952 | Mackechnie, Jr. | 227/155 |
| 3,986,533 | 10/1976 | Woodman, Jr. | 227/155 |
| 4,546,910 | 10/1985 | Logtens | 227/155 |
| 4,593,847 | 6/1986 | Hagemann | 227/155 |

FOREIGN PATENT DOCUMENTS

| | | | |
|---|---|---|---|
| 0051395 | 5/1982 | European Pat. Off. . | |
| 0013159 | 8/1985 | European Pat. Off. | B27F 7/19 |
| 0266700 | 5/1988 | European Pat. Off. . | |
| 0009964 | 2/1993 | European Pat. Off. | B27F 7/30 |
| 96433 | 3/1973 | Germany . | |
| 4020355 | 6/1990 | Germany | B42B 4/00 |
| 4238249 | 6/1993 | Germany . | |
| 407043 | 8/1966 | Switzerland . | |
| 90/08015 | 7/1990 | WIPO . | |

*Primary Examiner*—Scott A. Smith

*Attorney, Agent, or Firm*—Lawrence P. Kessler

[57] ABSTRACT

A stapling device (1) comprises a clincher unit (3) with bending elements (30 and 31) by which the ends of a staple (34) driven through a sheet stack (35) are folded and bent onto the sheet stack (35). The bending elements (30, 31) are actuated by a pushrod (26, 27) whose end side facing the bending elements (30, 31) is provided with rotary rollers (28, 29) which roll on the bending elements (30, 31) during each working stroke in order to clinch the ends of the staples. During the return stroke of pushrod (26, 27) the reduced frictional load causes slippage to occur between the rollers (28, 29) and the bending elements (30, 31) so that continuously alternating contact points are brought into engagement. This results in a uniformly distributed, and consequently reduced, load on the rollers (28, 29) by which the service life of the clincher unit (3) is prolonged.

8 Claims, 4 Drawing Sheets

SHEET-STAPLING DEVICE

BACKGROUND OF THE INVENTION

1. Field of the Invention

The invention relates, in general, to a stapling device for the stapling of sheets arranged in stacks, and more particularly to a stapling device comprising a driver unit for driving a staple into a sheet stack from one side and a clincher unit for folding the ends of the staples on the other side of the sheet stack, which clincher unit includes two similar, pivotally mounted and oppositely movable bending elements.

2. Background Art

DE-OS 40 20 355 discloses a stapling device which comprises a clincher unit with bending elements for folding and clinching the ends of a staple driven through a sheet stack. The bending elements of this known stapling device are actuated by a pushrod whose straight end face running parallel to the plane of the sheet stack engages the bending elements such that they slide along the end face of the pushrod.

SUMMARY OF THE INVENTION

It is the object of the invention to provide a stapling device where the frictional conditions between the pushrod and the bending elements are improved and a long service life of the clincher unit is attained.

According to the invention this object is attained by a stapling device comprising a driver unit for driving a staple into a sheet stack from one side and a clincher unit for folding the ends of the staples on the other side of the sheet stack, which clincher unit includes two similar, pivotally mounted and oppositely movable bending elements. The bending elements are arranged symmetrically with respect to the position of said staple as well as in the longitudinal direction of said staple and whose surfaces facing away from the ends of the staples are engaged by a common actuator which is movable rectilinearly as well as perpendicularly to the plane of the sheet stack, the bending elements being pivotally mounted in the area of their first ends situated outside the staple position and the actuator engaging the second free ends of the bending elements which face each other and are arranged above the staple. Each of the surfaces of the bending elements facing away from the ends of the staples is engaged by a roller and the rollers are mounted for rotation on the common actuator which is designed as a rectilinearly movable pushrod.

According to a modification of the invention, the rollers have flanges on either side and are each provided with a journal and mounted for rotation on a two-part pushrod consisting of two identically designed components which can be brought into positive engagement.

According to another modification, the rollers are engaged by a backstop such that they are only rotatable during the working stroke of the pushrod.

The invention, and its objects and advantages, will become more apparent in the detailed description of the preferred embodiments presented below.

BRIEF DESCRIPTION OF THE DRAWINGS

Further features and advantages can be inferred from the description of the invention illustrated in the drawings. In the drawings.

DETAILED DESCRIPTION OF THE INVENTION

Referring to the accompanying drawings, a stapling device 1 according to the invention is arranged on a known type of finisher unit not illustrated in which individually fed sheets, in particular copy sheets supplied by a copier, are collected in a stack in a collecting station 36 and combined in sets by means of staples. The stapling device is a comprehensive assembly unit of a general construction described for example in DE-OS 40 20 355. To facilitate understanding of the invention, only those parts are shown and described in detail which are of essential importance to the invention while the remaining structure of the stapling device 1 is schematically illustrated.

Figure 1:
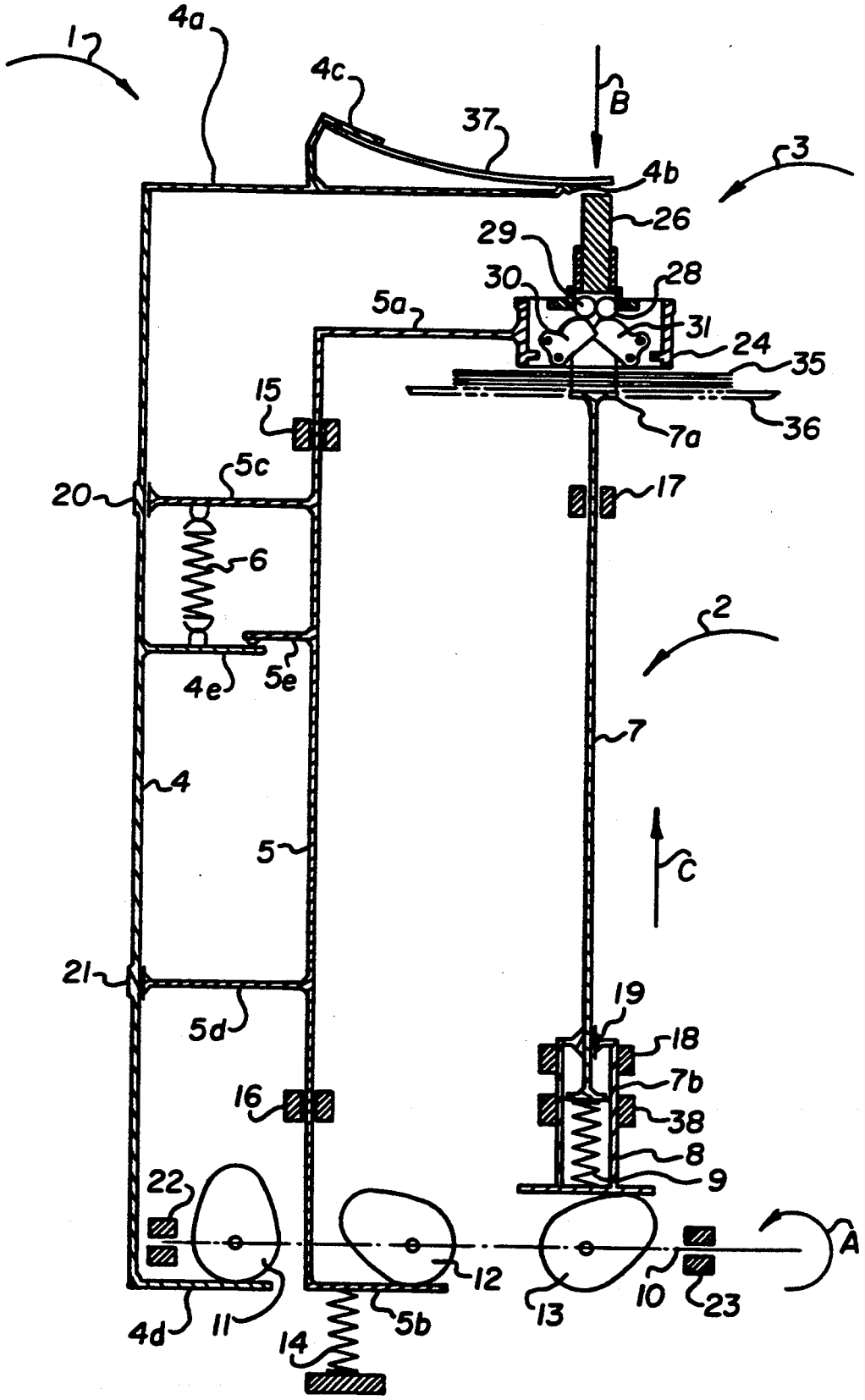
FIG. 1 a side elevational view, partially in cross-section, of the stapling device, according to this invention, with the clincher unit in its initial position.

Stapling device 1 substantially comprises a driver unit 2 and a clincher unit 3. Clincher unit 3 is actuated by a slider 4 and a leaf spring 37 attached to the slider. The driver unit 2, the clincher unit 3 and the slider 4 are actuated by control cams 11 and 12 and 13, respectively (which for better understanding are shown in FIG. 1 in a position in which they have been rotated by 90° relative to their plane of operation). The control cams are connected to a shaft 10 mounted for rotation in bearings 22, 23 and driven by a motor in the direction of the arrow "A".

The sheets 35 to be stapled are fed into a collecting station 36 where they are aligned with abutments (not illustrated) and collected in a stack in a manner known per se. At this point, the driver unit 2 and the clincher unit 3 are sufficiently retracted to allow free passage of the incoming sheets. Below collecting station 36, a driver member 7 of driver unit 2 is shiftably mounted in guide means 17, 19 and supported at its lower end **7*b* by a pressure spring 9. Pressure spring 9 is arranged in a sleeve 8 which is shiftably guided in guide means 18, 38 and held in engagement with the third control cam 13. The upper end 7*a* of driver member 7 serves to drive the staples 34 into the collected sheet stack 35. The staples 34** to be driven in are formed in a manner known per se and not illustrated from a belt of wire sections supplied from a magazine (not illustrated).

Above collecting station 36, and opposite driver member 7, the clincher unit 3 is arranged as an assembly group positioned on a holder 24. Holder 24 is attached to an upper arm **5*a* of a first slider 5 which is shiftably mounted in guide means 15, 16. A lower arm 5*b* of slider 5 is urged into contact with the second control cam 12 by a pressure spring 14**.

Figure 2:
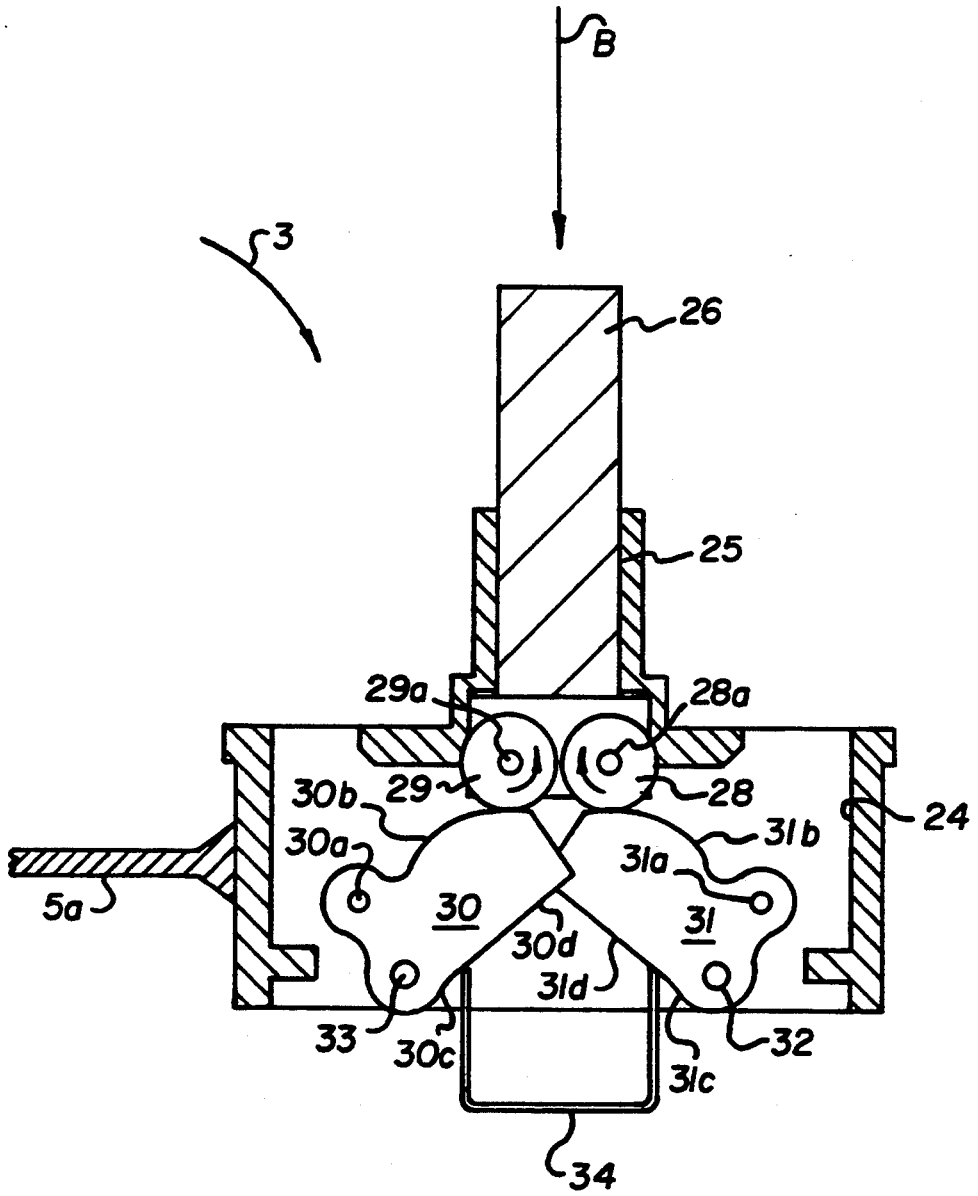
FIG. 2 is a side elevational view, on an enlarged scale, of the clincher unit as shown in FIG. 1.
Figure 3:
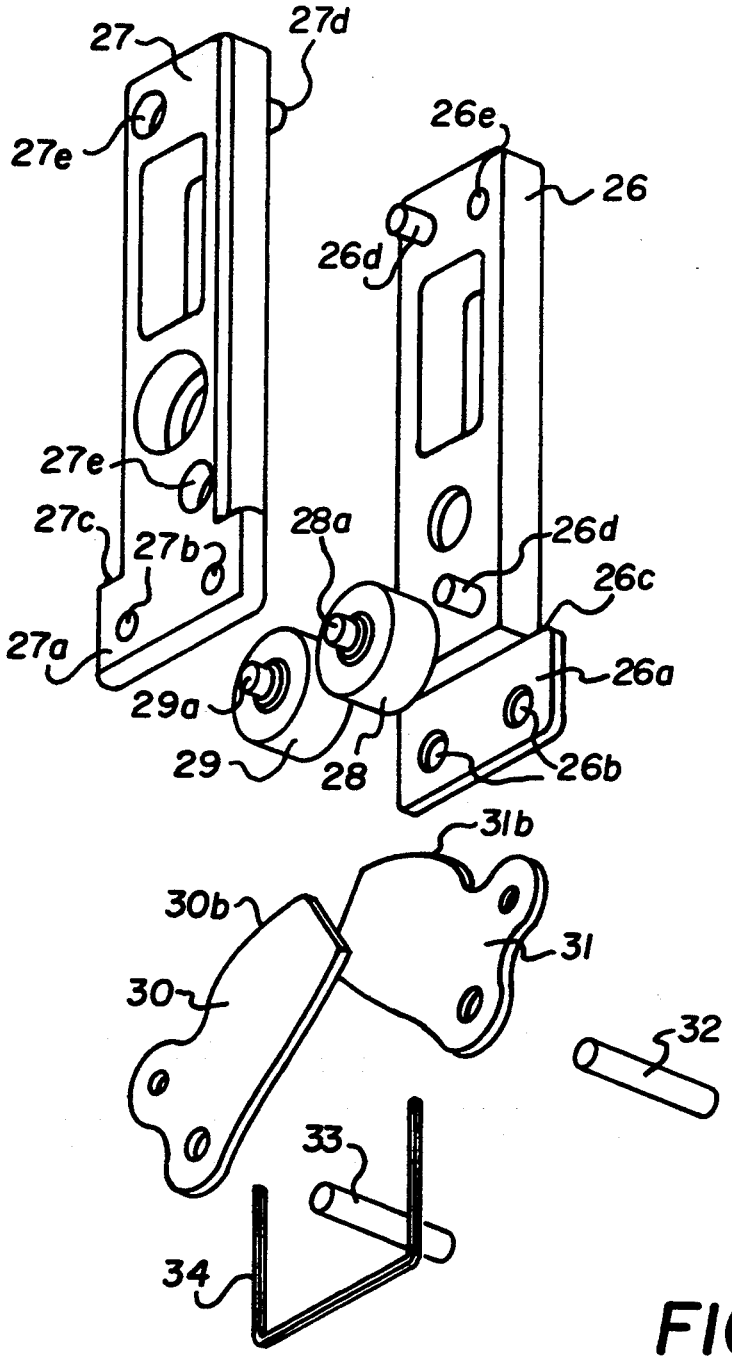
FIG. 3 is an exploded view, in perspective, of components of the clincher unit as shown in FIG. 2.

Fixed to holder 24 (see FIG. 2) is a guide sleeve 25 in which a two-part pushrod 26, 27 is shiftably mounted. Holder 24 and guide sleeve 25 are made of plastic. As shown in particular in FIG. 3, pushrod 26, 27 is a diecast element composed of two identical portions which are positively connected by projections 26*d* and 27*d*, respectively, engaging oppositely arranged recesses 26*e* and 27*e*, respectively.

Figure 4:
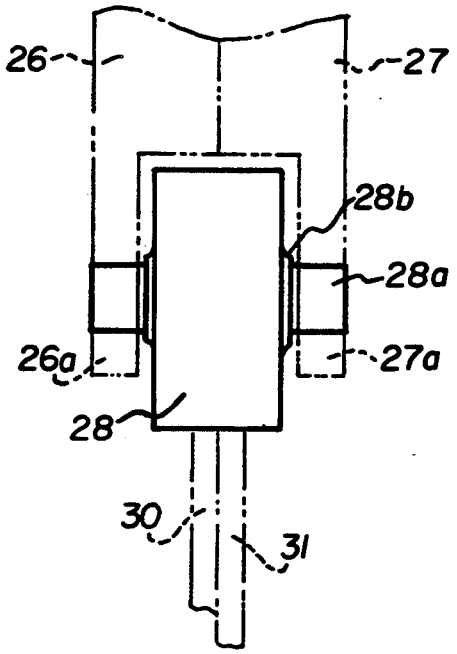
FIG. 4 is an end view, on an enlarged scale, of a roller of the clincher unit as shown in FIGS. 1 to 3.

The pushrod portions 26 and 27, respectively, have stepped undercut mounting webs 26*a* and 27*a*, respectively, including mounting bores 26*b* and 27*b*, respectively, for mounting two identically designed rollers 28 and 29. As can be seen in particular from FIG. 4, the mounting webs 26*a* and 27*a* surround the rollers 28 and 29 in a forklike manner. The rollers 28 and 29 are provided with integrally formed journals 28*a* and 29*a* as well as with flanges 28*b* on either of their sides. The flanges 28*b* assist in the low-friction mounting of the rollers 28 and 29. The rollers 28 and 29 are made of hardened steel and are graphite-coated. The ratio of the diameters of the rollers 28, 29 to those of the journals 28*a*, 29*a* is 4:1.

Pushrod 26, 27 with its rollers 28, 29 is guided for movement vertically to the plane of the sheet stack and arranged symmetrically with respect to staple 34. The projections 26*d*, 27*d* and the recesses 26*e*, 27*e* of the pushrod portions 26 and 27 are designed such that the pushrod portions 26, 27 can be riveted to form a unit after the rollers 28, 29 have been inserted, with the rollers 28, 29 being capable of free rotation after such riveting.

Two identically designed blade-shaped bending elements 30 and 31 of hardened steel are also arranged on holder 24 and mounted for rotation about journals 32, 33. The bending elements 30, 31 arranged in the longitudinal direction of staple 34 are mounted at one of their ends outside staple 34 (journal 32 and 33 respectively) and with their other ends extending within the inner space of staple 34. Each of the bending elements 30 and 31, respectively, is associated with one end of a staple 34 driven through the sheet stack 35. The bending elements 30 and 31 are arranged symmetrically with respect to the position of the staple, movable towards and away from each other and positioned parallel and directly adjacent to each other. At their surfaces remote from staple 34, the bending elements 30 and 31 each have a convex curvature 30*b* and 31*b*, respectively, of an involute shape which is each contacted by a roller 28 and 29, respectively. At their surfaces facing staple 34, the bending elements 30, 31 are each provided with a first surface section located adjacent to the journals 32 and 33, respectively, and showing a concave curvature 30*c*, 31*c*. This section is followed by a section 30*d*, 31*d* each having a convex curvature and associated with the inner space of staple 34.

Return springs (not illustrated), with a relatively low tension, engage bores 30*a* and 31*a*, respectively, of the bending elements 30 and 31, respectively, for urging the bending elements 30 and 31, respectively, with their convex curvatures 30*b* and 31*b*, respectively, into contact with the rollers 28 and 29, respectively. At the same time, the return springs urge the pushrod 26, 27 in the direction towards an initial position.

The driver unit 2 is actuated by a second slider 4 which is slidably mounted in guide means 20 and 21 arranged on arms 5*c*, 5*d* of the first slider 5. A central arm 4*e* of the second slider 4 is influenced by a tension spring 6 which is attached to arm 5*c* of the first slider 5 such that arm 4*e* is spring-urged into contact with a projection 5*e* of the first slider 5. The second slider 4 has an upper and a lower arm 4*a* and 4*d* respectively. Mounted to a holder 4*c* of the upper arm 4*a* is a leaf spring 37 which extends with its free end over pushrod 26, 27 of the clincher unit 3. Leaf spring 37 is urged into contact with end 4*b* of the upper arm 4. The lower arm 4*d* of the second slider 4 engages the first control cam 11.

The stapling device functions as follows:

FIG. 1 shows the stapling device in an initial position in which holder 24 of clincher unit 3 is spaced from collecting station 36 such that incoming sheets can pass freely up to the aligning abutments (not illustrated). As soon as the number of sheets to be stapled has been collected in a sheet stack 35, shaft 10 is made to rotate by the drive (not illustrated) so that the control cams 11, 12 and 13 are rotated in the direction of the arrow "A". During such movement, the second control cam 12 causes the lower arm 5*b* of the first slider 5 to move downwards and the holder 24 of clincher unit 3 to move closer to sheet stack 35 without the stack being directly contacted. The control cams 12 and 13 are provided with concentric circular sections (not illustrated) which are brought into engagement if the control condition reached is to be continued. Due to the concentric section of the second control cam 12, the first slider 5 controlled by it remains in its lowermost position while the third control cam 13 shifts sleeve 8 and, via pressure spring 9, driver element 7 upwards in the direction of the arrow "C". Pressure spring 9 is strong enough to resist compression during such movement.

During movement of driver element 7 in the direction of the arrow "C", a wire section of the stapling-wire belt is bent to form a staple 34 which is severed from the belt and driven into the sheet stack 35 from below. During this operation, the sheet stack 35 is moved into contact with the lower side of holder 24. At the end of the driving operation, the ends of staple 34, which extend upwardly from sheet stack 35, make contact with the convex curvatures 30*c*, 31*c* of the bending elements 30, 31 whereby the ends of the staple 34 are slightly bent inwardly towards each other. At the end of the driving operation a sheet stack thickness compensation is effected in that pressure spring 9 is compressed. The concentric circular sections of control cams 12 and 13, which are now effective, cause both the driver member 7 and the first slider 5 to remain in their positions while at the same time the first control cam 11 starts moving the second slider 4.

Via lower arm 4*d*, the first control cam 11 moves the second slider 4 downwards in opposition to the direction of the arrow "C" so that leaf spring 37 arranged at the upper arm 4a contacts pushrod 26, 27 and moves such rod downwards in the direction of the arrow "B" in opposition to the weak spring urging influencing the bending elements 30 and 31. This causes arm 4*e* of the second slider 4 to move away from projection 5*e* of the first slider 5 while tension spring 6 is tensioned. During movement of the pushrod in the direction of the arrow "B", the rollers 28 and 29 pivot the bending elements 30 and 31 onto the upper surface of sheet stack 35. During this pivotal movement, the concave curvatures 30*c*, 31*c* of the bending elements 30 and 31 bend the ends of staple 34 further inwardly before the ends are pressed against sheet stack 35 in a flat position by the convex surface sections 30*d* and 31*d*. During movement of pushrod 26, 27 in the direction of the arrow "B", the rollers 28 and 29, respectively, roll over the convex curvatures 30*b* and 31*b*, respectively, of the bending elements 30 and 31, respectively, rotating in opposite directions as indicated by the arrows in FIG. 2. As a result of the frictional rolling movement between the rollers 28 and 29 and the bending elements 30 and 31, continuously alternating contact points are brought into engagement during pivotal movement of the bending elements 30, 31. This prevents the drive of the bending elements 30, 31 from being inhibited by sliding friction. Leaf spring 37 is urged to such an extent that it continues to rest against the end **4*b* of slider arm 4*a* during the clinching of staple 34. Only when the ends of staple 34 rest on sheet stack 35 is leaf spring 37 lifted from the end 4*b* of slider arm 4*a*** and thus allows the various movements to be compensated.

After the stapling operation has been terminated, the control cams 11, 12 and 13 are further rotated in the same direction. The concentric section of the third control cam 13 moves out of contact with sleeve 8 so that pressure spring 9 is relieved and driver member 7 moves back in opposition to the direction of the arrow "C". When driver member 7 is returned, the control cams 11 and 12 also change their positions. This causes the first slider 5 to move, under the action of pressure spring 14, to its upper position in which holder 24 of clincher unit 3 once again assumes its raised initial position. Rotation of the first control cam 11 moreover causes the pre-tensioned tension spring 6 to pull the second slider 4 upwards in the direction of the arrow "C" until its arm **4*e* rests against projection 5*e* and slider 4 once again assumes its initial position in which it is shown in FIG. 1**.

During the return movement of the second slider 4 pushrod 26 and 27 and the bending elements 30, 31 are also returned to their initial positions shown in FIG. 1 under the influence of the urging springs. Since the return springs are relatively weak, the pressure produced between the bending elements 30, 31 and the rollers 28, 29 during the return of pushrod 26, 27 is relatively low so that a certain amount of slippage occurs between them. This advantageously brings different circumferential portions of the rollers 28, 29 into engagement with the bending elements 30, 31 so that the rollers 28, 29 are subjected to a uniform, and therefore small, load both by their rolling movement and by the relative rotation. Accordingly, the service lives of the rollers 28, 29 and the bending elements 30, 31 are considerably prolonged. When the initial position according to FIG. 1 is reached the drive of stapling device 1 is turned off.

Since the pressure load exerted in clincher unit 3 on the bending elements 30, 31 changes between the working stroke and the return stroke of pushrod 26, 27, the load on the rollers 28, 29 moving the bending elements 30, 31 is uniformly distributed over the circumference thereof and altogether reduced. In contrast to this automatically effective continuous rotation of the rollers 28, 29, such rotary movement can also be directionally constrained if the prevailing pressure conditions call for such a type of control. For this purpose, the rollers 28, 29 need just be associated with a backstop so that they are rotated as described during each working stroke while being prevented from rotation during the return stroke of pushrod 26, 27. This, too, ensures a uniform load distribution over the circumference of the rollers 28, 29.

Figure 5:
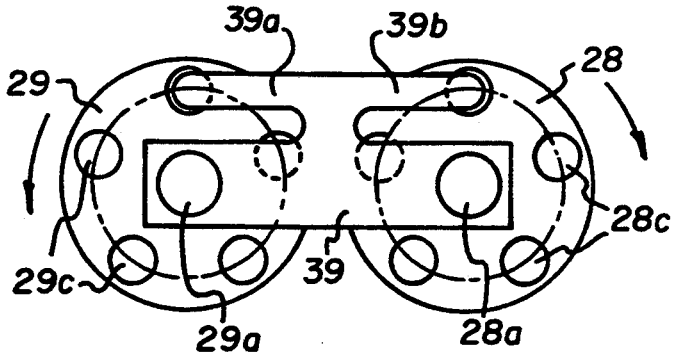
FIG. 5 is a side elevational view of an alternate embodiment of a pair of rollers for the clincher unit including a backstop.
Figure 6:
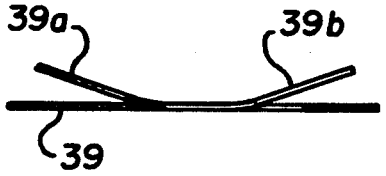
FIG. 6 is a top plan view of the backstop shown in FIG. 5.

An embodiment of such a backstop is described in the following with reference to FIGS. 5 and 6. A backstop 39 of the type illustrated in FIGS. 5 and 6 is arranged between the rollers 28, 29 and one of the mounting webs **26*a* or 27*a* of pushrod 26, 27. Backstop 39 is plugged onto the two journals 28*a* and 29*a* and includes two resilient locking arms 39*a* and 39*b* cooperating with recesses 28*c* and 29*c*, respectively, of the rollers 28 and 29, respectively. For this purpose, each of the rollers 28 and 29 has one of its flanks provided with a plurality of recesses 28*c* and 29*c*, respectively, concentrically spaced at equal distances about the journals 28*a*, 29*a*. The resilient locking arms 39*a* and 39*b*, respectively, are symmetrically arranged with respect to a center of backstop 39, which is located centrally between the journals 28*a* and 29*a*. The locking arms 39*a*, 39*b* of equal lengths are arranged in parallel with a line connecting the axes of rotation of the journals 28*a*, 29*a*. Each of the locking arms is bent towards the flanks of the rollers and slightly urged such that they can be brought into engagement with the recesses 28*c* and 29*c*, respectively. The ends of the locking arms 39*a* and 39*b* engaging the recesses 28*c* and 29*c*, respectively, are suitably shaped (rounded) and provided with surfaces (level) ensuring low-friction operation. During the working stroke of pushrod 26, 27 in the direction of the arrow "B" backstop 39, 39*a*, 39*b* according to FIGS. 5 and 6 allows the rollers 28, 29 to be rotated in the directions indicated by the arrows, and thus in the manner as described with reference to FIGS. 1 to 4. However, the rollers 28, 29 are prevented from rotating, or restrained in their movement, in the opposite directions in that the locking arms 39*a* and 39*b* engage the nearest recess 28*c* and 29*c***, respectively.

In contrast to the embodiments illustrated in the drawings, the rollers 28, 29 may also be mounted side by side for idle movement about a shaft (not illustrated) if the bending elements 30,31 are long enough to pass below the common axis of rotation. The contact flanks of such adjacently arranged rollers are preferably separated from each other by an idly rotating washer in order to facilitate rotating of the rollers in opposite directions.

The invention has been described in detail with particular reference to preferred embodiments thereof, but it will be understood that variations and modifications can be effected within the spirit and scope of the invention as set forth in the claims.

What is claimed is:

1. Stapling device for stapling sheets arranged in stacks, said device comprising a driver unit for driving a staple into the sheet stack from one side and a clincher unit for clinching the ends of the staple on another side of the sheet stack, said clincher unit includes two similarly designed, pivotally mounted and oppositely movable bending elements which are arranged symmetrically with respect to said staple as well as in a longitudinal direction of said staple and having surfaces facing away from the staple ends which are engaged by a common actuator which is movable rectilinearly as well as perpendicularly to a plane of the sheet stack, the bending elements being pivotally mounted at first ends situated longitudinally outside the staple position and the actuator engaging second free ends of the bending elements which face each other and are arranged above the staple, characterized in that each of the surfaces (**30*b*, 31*b*) of the bending elements (30, 31), which faces away from the staple ends, is engaged by a respective roller (28, 29) and in that said rollers (28, 29) are mounted for rotation on said common actuator which is a rectilinearly movable pushrod (26, 27), said stapling device further comprising a backstop (39) for engaging said rollers (28, 29**) such that each of said rollers can be rotated in one direction only.

2. Stapling device according to claim 1, characterized in that said rollers (28, 29) are arranged one behind the other in the longitudinal direction of the staple (34).

3. Stapling device according to claim 1, characterized in that said rollers (28, 29) are arranged side by side for free rotation about a common journal.

4. Stapling device according to claim 1, characterized in that said rollers (28, 29) have flanges (**28*b*, 29*b*) and journals (28*a*, 29*a***), respectively, provided on both sides of said rollers.

5. Stapling device according to claim 1, characterized in that said rollers (28, 29) are arranged at a fork-shaped end (**26*a*, 27*a*) of said pushrod (26, 27**).

6. Stapling device according to claim 5, characterized in that said push rod (26, 27) consists of two identical components which can be positively connected.

7. Stapling device according to claim 6, characterized in that the pushrod components (26, 27) have integral projections (**26*d*, 27*d*) which positively engage oppositely arranged recesses (26*e*, 27*e*), wherein said projections (26*d*, 27*d*) and said recesses (26*e*, 27*e*) are arranged such that the pushrod components, when assembled, (26, 27**) can be riveted together.

8. Stapling device according to claim 1, characterized in that said backstop (39) comprises two symmetrically arranged resilient locking arms (**39*a*, 39*b*) biased towards the rollers (28, 29), and each of said rollers (28, 29) is provided with recesses (28*c*, 29*c*) for engagement with one of the locking arms (39*a* and 39*b***, respectively).

* * * * *